United States Patent [19]
Orlov et al.
[11] 4,449,754
[45] May 22, 1984

[54] DEVICE FOR BREAKING MONOLITHIC STRUCTURES BY PULSEWISE LIQUID PRESSURE

[75] Inventors: Naum Y. Orlov, Kharkov; Taras P. Dotsenko, Moscow, both of U.S.S.R.

[73] Assignee: Vsesojuzny Proektno-Izyskatelsky I Nauchno-Issledovatelsky Institut "Gidropoekt" Imeni S.Ya. Zhuka, Moscow, U.S.S.R.

[21] Appl. No.: 386,919

[22] Filed: Jun. 10, 1982

[30] Foreign Application Priority Data

Nov. 24, 1980 [SU] U.S.S.R. ..... 3006632
Dec. 3, 1981 [SU] U.S.S.R. ..... 3356551

[51] Int. Cl.³ ..... E21C 37/12
[52] U.S. Cl. ..... 299/21; 102/304; 102/333; 299/13; 299/16
[58] Field of Search ..... 299/13, 16, 21; 102/325, 319, 333, 304; 241/1

[56] References Cited

U.S. PATENT DOCUMENTS 318,771 5/1885 McCall ..... 102/304
3,960,082 6/1976 Sloevsky et al. ..... 299/13 X

FOREIGN PATENT DOCUMENTS 628934 9/1936 Fed. Rep. of Germany ..... 102/333
3150 of 1876 United Kingdom ..... 102/333

*Primary Examiner*—Ernest R. Purser
*Attorney, Agent, or Firm*—McAulay, Fields, Fisher, Goldstein & Nissen

[57] ABSTRACT

A device for breaking monolithic structures or pulsating by inducing pressure in a liquid filling a pre-drilled hole in the monolithic structure to be shattered comprises a tubular housing having a cavity for accommodating an explosive charge. Provided in the lower portion of the housing is a partition of an elastomeric material and a pipe serving to locate the device in a mouth of the hole and be filled with the liquid so as to form an air gap between the partition and the surface of the liquid. In order to retain the device inside the hole a means is provided connected to the housing and fashioned as an inertia element disposed outside the hole.

9 Claims, 2 Drawing Figures

DEVICE FOR BREAKING MONOLITHIC STRUCTURES BY PULSEWISE LIQUID PRESSURE

This invention relates to equipment utilized for pit the quarry operation as well as for construction and maintenance, and concerns more specifically devices for breaking monolithic structures by pulsewise liquid pressure.

Industrial Applicability

The herein proposed device can find application for shattering such monolithic structures as oversize solid rocks and rock formations in tunneling and quarrying, as well as for breaking old concrete and reinforced concrete structures prior to the construction of new buildings, etc.

Background of the Invention

At present, widely utilized for breaking monolithic structures are various devices of the so-called hydraulic wedge type and electrohydraulic breaking devices. Among the disadvantages inherent in these known devices are their bulky construction, high manufacturing costs, and incapability of independent performance, since these devices need a supply of mechanical or electric power for their operation.

Conversely, there are known portable light-weight devices for breaking monolithic structures by pulsewise liquid pressure which are lowered into a hole predrilled in the material to be broken and pre-filled with water. These devices are much simpler and less expensive to manufacture and operate.

One such device for down-the-hole breaking rock, concrete and reinforced concrete by pulsewise high liquid pressure is exemplified in U.S. Pat. No. 3,960,082, published June 1, 1976. It comprises a tubular housing having a chamber for accomodating an explosive charge confined on one end of the housing by a partition of an elastomeric material, and connected to the housing a means for retaining the housing in a predrilled hole when a pulse pressure is indiced. The housing is hollow inside and is provided with lateral drillings wherethrough it communicates with the interior of the hole occupied by a liquid filled into the hole when the device is lowered thereinto. This hollow of the housing is separated from the chamber accommodating the explosive charge by said partition of an elastomeric material.

When the explosive charge is initiated this partition is ruptured due to a pressure produced by the explosion gases whereby the chamber communicates with the interior or hollow of the housing and thus induced pulsewise high liquid pressure acts on the walls of the hole. The means for retaining the housing inside the hole is fashioned as a ring element fabricated from an elastomeric material. The ring is tightly fitted onto the lower portion of the housing having a smaller diameter and provided with additional radial drillings or passages, the ring being adapted to close these passages. Therefore, when a pulsewise liquid pressure is induced, the elastic ring is pressed against the walls of the hole eliminating a gap existing between the housing and the walls of the hole and thereby holding the device inside the hole.

The aforedescribed arrangement of the means for retaining the housing inside the hole has been found to reduce the efficiency of the device, because part of the pulse pressure energy is shielded by the walls of the housing without effecting a useful work to shatter the monolithic structures.

More specifically, the useful work is performed only by part of the pulse acting on the walls of the hole through the passages of the housing, the rest of the pulse energy being expended for the resilient deformation of the elements of the device.

Summary of the Invention

It is therefore an object of this invention to provide a device for breaking monolithic structures by pulsewise pressure of a liquid occupying a hole pre-drilled in the structure to be shattered, which device would improve the effectiveness of the pulsewise pressure and would ensure a reliable holding of the housing of the device inside the hole through out the duration of the pulse.

The object is attained by that in a device for breaking monolithic structures by pulsewise pressure of a liquid occupying a hole pre-drilled in the structure to be shattered comprising a tubular housing having a cavity to accommodate an explosive charge confined on one end of the housing by a partition of an elastomeric material, and means for retaining the device inside the hole when a pulse pressure is induced therein, the means including an inertia element connected to the housing, according to the invention, the housing has a pipe portion at the end thereof adjacent to the partition, the pipe portion being lowered into a mouth of the hole so as to provide an air gap between the surface of the liquid in the hole and the partition, the means inertia element being connected to the housing by a partially movable joint inside the hole being fashioned as an inertia element located outside the hole.

Preferably, when the device is used for breaking monolithic structures of large mass and is normally installed on a vehicle, the inertia element has the form of a plunger arranged for axial reciprocations inside the housing and adapted to confine from above the cavity which accommodates the explosive charge, the plunger having at least one passage arranged axially of the housing and adapted to communicate in the uppermost position thereof the cavity containing the explosive charge with the atmosphere.

When designed for use as a portable tool, it is advisable that the device embodying the present invention be provided with the inertia element connected to the housing through a resilient shock absorbing gasket spacer; in the form of a metal block secured to the free end of a bracket which is fixedly attached to the housing in a cantilever fashion.

Preferably, the bracket is fashioned as a resilient rod-like member.

Advisably, a cushioning spacer is interposed between the metal block and the bracket.

The aforedescribed arrangement of the means for retaining device for breaking monolithic structures by pulsating liquid pressure in the hole provides a drastic increase in the overall efficiency of the device, because substantially all the energy of the pulses is transmitted through the pipe portion to the walls and bottom of the hole.

Besides the pulsating pressure at the bottom of the hole is substantially augmented due to shock wave interference.

The provision of an air gap between the elastomeric partition and the surface of the liquid in the pipe portion enables to reduce the shock wave front affecting directly the walls of the pipe portion, which enables to attain a highest pulse pressure away from the pipe portion by virtue of making use of the effect of cumulation of the shock waves, which enhances further the efficiency of the device and extends its service life.

Brief Description of the Drawings

The invention will now be described in greater detail with reference to specific embodiments thereof taken in conjunction with the accompanying drawings, in which.

Detailed Description of the Invention

Figure 1:
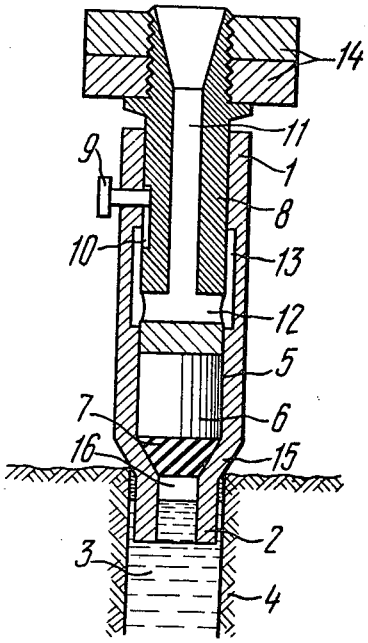
FIG. 1 is a longitudinal sectional view of a device for breaking monolithic structures by pulsewise liquid pressure embodying the present invention provided with an inertia element fashioned as a plunger.

With reference to FIG. 1 the device for breaking monoliths by pulsewise liquid pressure in the case to be described specifically adapted for breaking monoliths of great mass, comprises a tubular housing 1 having at the lower end thereof a pipe portion 2 of a diameter substantially less than the diameter of the housing 1, the pipe portion 2 being received by the mouth of a hole pre-drilled in a monolithic structure 4 to be broken. The housing 1 has a cavity 5 to accommodate an explosive charge, such as a pyropowder charge. A partition 7 is provided in the lower part of the housing 1 to close the cavity 5 from below, the partition being fabricated from an elastomeric material, such as rubber. The cavity 5 is closed from above by the end face of a plunger 8 serving as an inertia element of the device to keep the housing 1 inside the hole. The plunger 8 is adapted to reciprocate axially of the housing 1. To prevent the plunger 8 from being driven from the housing 1 under the action of centrifugal forces, a stop element 9 is arranged in the upper part of the housing 1, the stop 9 cooperating with a longitudinal groove 10 in the plunger 8.

In the lowermost position of the plunger 8 the end face thereof closes from above the cavity 5 wherein the explosive charge is accommodated, while in the uppermost position of the plunger 8 the cavity 5 communicates with the atmosphere. In order to effect such a communication, an axial passage 11 is provided in the body of the plunger 8, the passage 11 having a dead end at the bottom portion of the plunger 8, and radial drillings 12, while the housing 1 has recesses 13.

The passage 11 diverges upwards, whereas the plunger 8 has a set of weights 14 secured on the upper portion thereof to change the overall mass of the plunger and, consequently, vary the inertial properties of the plunger 8 to conform to the magnitude of the explosive charge 6 selected. The inertial properties of the plunger 8 are selected such as to ensure a minimum displacement of the lower end face thereof within a time necessary to complete a hydraulic shock wave phase in the hole 3 and cause a crack in the monolithic structure being broken. Because the duration of such processes is normally measured in thousandths of one second, the overall weight of the plunger 8 with the weights 14 to counteract the charge 6 of between 9 and 10 grams of powder may approximate 30 kg.

A difference between the diameters of the housing 1 and the pipe portion 2 is normally selected such as to ensure that a force arising due to the action of explosion gases in the cavity 5 and acting to press the housing 1 to the mouth of the hole 3 is greater than a force arising due to the action of the pressure of liquid on the end of the pipe portion 2 and tending to drive the device away from the hole 3. The aforegoing provides that the housing 1 is retained in the hole 3 when a liquid pressure pulse is produced.

To reduce the shattering effect of the hydraulic shock wave in the pipe portion 2 it is necessary that while mounting the pipe portion 2 in the mouth of the hole 3 pre-filled with a liquid care be taken to form an air gap 16 of 10–15 mm between the liquid and the partition 7. Normally, this gap 16 is formed spontaneously by virtue of the compression of the air contained in the pipe portion 2 prior to securing the device in the hole 3.

Figure 2:
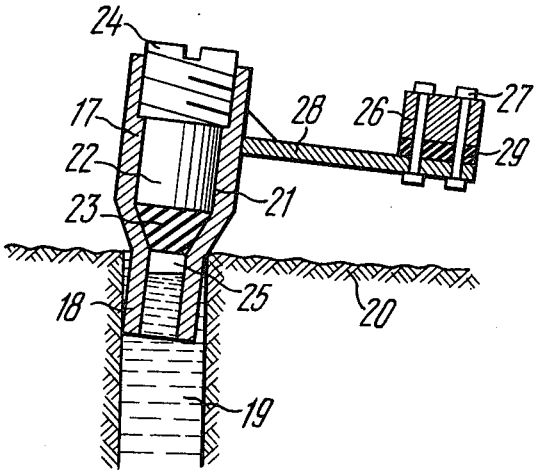
FIG. 2 is a longitudinal sectional view of an embodiment of the device for breaking monolithic structures wherein the inertia element through a resilient shock absorbing gasket.

Referring now to FIG. 2, there is shown another modified form of the device for breaking monolithic structures by pulsewise liquid pressure, in this case adapted for use as a portable tool. This device comprises a tubular housing 17 the lower end of which has a pipe portion 18 to be received by the mouth of a hole 19 pre-drilled in a structure 20 and filled with a liquid, such as water. To prevent the housing 17 from sinking into the hole 19, the diameter of the housing exceeds the diameter of the pre-drilled hole 19, while the diameter of the pipe portion 18 is substantially less than the diameter of the hole 19.

The housing 17 has a chamber or cavity 21 for placing an explosive charge therein. The lower portion of the housing 17 is provided with a partition 23 of an elastomeric material confining the cavity 21 from below, the cavity 21 being further closed from above by the lower end face of a plug member 24.

When installing the device in the hole 19 care must be taken that the pipe portion 18 is occupied by the liquid so as to form between the partition 23 and the liquid an air gap 25.

The device also comprises means for retaining the housing 17 inside the hole 19 when a pulse pressure is initiated therein. The means include an interia element connected to the housing through a resilient shock absorbing spacer. Provision is made for displacement of the means for retaining the device in the hole through the elastic deformation of the gasket.

In the herein proposed modified form of the device this inertial element is fashioned as a metal block 26 secured such as by bolts 27 on the free end of a bracket 28 attached to the housing 17 as by welding.

In order to improve the inertial properties, it is advisable that the bracket 28 be in the form of a resilient rod-like member.

Advantageously, a cushioning spacer 29, for example, of rubber is placed between the metal block 26 and the bracket 28.

The inertial properties of the means for retaining the device inside the hole 19 depend on the mass of the metal block, resilient properties of the spacer 29 and the bracket 28 and on the length of the bracket 28.

These properties are selected so as to ensure that the metal block 26 remains stationary or moves but a little within a time necessary for completing the phase of a hydraulic shock wave in the hole 19 to form a crack in the monolithic structure 20, because subsequent to cracking the amplitude of the liquid pressure pulse is sharply reduced due to a runoff of the liquid into the cracks thus formed resulting in a sudden decrease of the force tending to drive the device from the hole. In view of the fact that the duration of the phase of the hydraulic shock wave is never in excess of several milliseconds, a preferable weight of the block 26 is about 15 kg at a length of the bracket 28 of 0.5 m.

The device for breaking monolithic structures by pulsewise high liquid pressure embodying the present invention and illustrated in FIG. 1 operates as follows.

A hole 3 is drilled in the monolithic structure 4 to be broken and is filled with a liquid, whereafter the pipe portion 2 of the housing 1 is lowered into the hole mouth, an air gap 16 remaining between the surface of the liquid and the partition 7 after the liquid has entered the pipe portion 2.

When the explosive charge 6 is initiated, the resulting explosion gases act to press on the partition 7 to move it into the pipe portion 2 thereby producing a pulsewise liquid pressure in the form of a hydraulic shock wave to cause the formation of cracks in the structure 4.

Therewith, thanks to the provision of the air gap 16 the wave front drops to be raised outside the pipe portion 2 at the outlet into the hole 3 whereby the pipe portion 2 is not destroyed by the shattering effect of the shock wave which results in a more efficient operation and longer life of the device.

Thanks to the cumulative effect of the shock wave, a maximum shock front to shatter the monolith is attained away from the pipe portion 2.

Simultaneously with the development of the hydraulic shock wave, a pressure of explosion gases in the cavity 5 acts on the housing 1 to press it to the mouth of the hole 3 and on the lower end face of the plunger 8 to move it upwards whereby the energy of the explosion gas directed upwards is absorbed. Further, due to the fact that the force pressing the housing 1 to the mouth of the hole 3 prevails over the force tending to drive the housing 1 from the hole 3, the device is retained inside the hole 3 when the pulsewise high liquid pressure is induced.

When on its travel upward the lower end face of the plunger 8 reaches the recesses 13, the monolith 4 is practically shuttered and the remaining explosion gases are caused to pass through the recesses 13 and the drillings 12 into the axial passage 11 to escape into the atmosphere producing a reaction force to counteract a further movement of the plunger 8 upward, while the pressure of the explosion gases inside the cavity 5 is gradually brought down.

The aforedescribed arrangement for dynamically stopping the upward movement of the plunger 8 at the end of the pressure pulse enables to more fully utilize the residual and sufficiently high pressure of the gases in the cavity 5 to suppress the kinetic energy of the plunger 8 and reduce the inertia loads exerted on the elements of the device without resorting to special means or adding to the weight of the plunger 8, which also raises the efficiency of the device according to the invention.

In view of the foregoing, the device makes it possible to more fully utilize the energy of explosion gases by eliminating unproductive losses of pressure for resilient deformation of the walls of the housing and through increasing the duration of the pressure pulse by way of improving the inertial properties of the device, which provides optimum conditions for the combustion of the explosive charge.

The device also enables to utilize the residual energy of explosion to bring down the dynamic loads exerted thereon at the end of a pressure pulse.

With reference to FIG. 2, the modified form of the device embodying the present invention operates in the following manner.

The pipe portion 18 is first lowered into the hole 19 similarly to what has been described with reference to the device of FIG. 1. During fitting the pipe 18 to the mouth of the hole 19 a static moment is induced acting to press the pipe portion 18 to the wall of the hole 19 due to its center of gravity being offset toward the metal block 26.

When the explosive charge 22 is initiated, the resulting gases force the partition 23 into the pipe portion 18 thereby inducing a pulse pressure in the form of a hydraulic shock wave.

At the same time, the pressure of liquid inside the hole 19 acts on the bottom end of the pipe 18 to produce a force tending to drive the device away from the hole 19. This force is then transmitted to the block 26 via the bracket 28. Thanks to the resilient deformation of the spacer 29, the moment when the pressure pulse of a highest amplitude starts to act and the moment when the inertia element starts to move are shifted in time. This provides a tilt of the housing 17 with respect to the block 26 when the pulse pressure of the highest amplitude is attained to result in jamming of the housing 17 in the hole 19, which prevents the housing 17 from being forced out of the hole 19.

Also, by virtue of the inertial properties of the block 26 a dynamic moment arises to augment the effect of jamming and prevent the device from being driven out of the hole 19.

The arrangement of the inertia element on the housing in a cantilever fashion makes it possible to considerably reduce the overall weight of the device and employ it as a portable tool.

What is claimed is:

1. A device for breaking monolithic structures by the pulsating pressure of a liquid occupying a hole predrilled in the structure to be shattered, comprising:

a tubular housing;

a cavity in said housing to accommodate an explosive charge;

a partition of an elastomeric material secured inside said housing to close said cavity at one end of said housing;

a pipe portion at the end of said housing adjacent to said partition adapted to fit into a mouth of said hole and to be filled with the liquid so as to form an air gap between the surface of the liquid and said partition;

means for retaining said housing inside the hole when a pulsating liquid pressure is induced, said means being provided with an inertia element; and a partially-movable joint connecting said element with said housing.

2. A device as claimed in claim 1, wherein:

said inertia element is in the form of a plunger arranged for axial reciprocations inside said housing and is adapted to close from above said cavity accommodating the explosive charge; and at least one passage is arranged axially of said housing and communicating in an uppermost position of said plunger with said cavity for placing said explosive charge in communication with the atmosphere.

3. A device as claimed in claim 1, wherein:

said inertia element is connected to said housing by means of a resilient shock-absorbing gasket-spacer.

4. A device as claimed in claim 2, wherein:

said inertia element is connected to said housing by means of a resilient shock-absorbing gasket-spacer.

5. A device for breaking monolithic structures by a pulsewise pressure of a liquid occupying a hole predrilled in the structure to be shattered comprising:

a tubular housing;

a cavity in said housing to accommodate an explosive charge;

a partition of an elastomeric material secured inside said housing to close said cavity at one end of said housing;

a pipe portion at the end of said housing adjacent to said partition to be fitted into a mouth of said hole and be filled with the liquid so as to form between the surface of the liquid and said partition an air gap;

a means for retaining said housing inside the hole when a pulsewise liquid pressure is induced, said retaining means having the form of an inertia element arranged outside said hole;

said inertia element having the form of a plunger arranged for axial reciprocations inside said housing and adapted to close from above said cavity accommodating the explosive charge; and at least one passage arranged axially of said housing and communicating in an uppermost position of said plunger with said cavity for accommodating the explosive charge with the atmosphere.

6. The device as claimed in claim 5, wherein:

said inertia element is fashioned in a metal block;

a bracket is secured to said housing in a cantilever fashion; and said inertia element is attached to a free end of said bracket.

7. The device as claimed in claim 6, wherein said bracket is a resilient rod-like member.

8. The device as claimed in claim 7, comprising: a cushioning spacer interposed between said metal block and said bracket.

9. The device as defined in claim 6, comprising a cushioning spacer interposed between said metal block and said bracket.

* * * * *